US009256195B2

(12) United States Patent
Shimizu et al.

(10) Patent No.: US 9,256,195 B2
(45) Date of Patent: Feb. 9, 2016

(54) DEVELOPMENT CARTRIDGE, PROCESS CARTRIDGE, AND IMAGE FORMING APPARATUS HAVING THE SAME

(71) Applicant: Brother Kogyo Kabushiki Kaisha, Nagoya-shi, Aichi-ken (JP)

(72) Inventors: Takashi Shimizu, Nagoya (JP); Atsushi Fukaya, Toyohashi (JP); Soun Kanada, Nagoya (JP); Hirofumi Kuriki, Nagoya (JP); Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/546,069

(22) Filed: Nov. 18, 2014

(65) Prior Publication Data

US 2015/0139692 A1 May 21, 2015

(30) Foreign Application Priority Data

Nov. 18, 2013 (JP) ..... 2013-238347
Nov. 18, 2013 (JP) ..... 2013-238353

(51) Int. Cl.

| | |
|---|---|
| ***G03G 15/00*** | (2006.01) |
| ***G03G 15/18*** | (2006.01) |
| ***G03G 21/16*** | (2006.01) |
| ***G03G 21/18*** | (2006.01) |

(52) U.S. Cl.

CPC ..... *G03G 21/1676* (2013.01); *G03G 21/1857* (2013.01); *G03G 2221/163* (2013.01)

(58) Field of Classification Search

CPC ..... G03G 21/1676; G03G 21/1817; G03G 21/1821; G03G 21/1857; G03G 2221/163; G03G 2221/1657; G03G 2221/1853

USPC ..... 399/119, 110, 111, 113

See application file for complete search history.

(56) References Cited

U.S. PATENT DOCUMENTS

| | | | | |
|---|---|---|---|---|
| 8,417,131 | B2 | 4/2013 | Mori | |
| 8,588,664 | B2 | 11/2013 | Takagi et al. | |
| 2006/0193645 | A1* | 8/2006 | Kishi | 399/12 |
| 2007/0009281 | A1* | 1/2007 | Sato et al. | 399/90 |
| 2011/0158688 | A1 | 6/2011 | Mori | |
| 2011/0158704 | A1 | 6/2011 | Takagi et al. | |
| 2012/0051795 | A1* | 3/2012 | Mushika et al. | 399/262 |
| 2012/0251165 | A1* | 10/2012 | Mushika et al. | 399/110 |
| 2013/0051852 | A1* | 2/2013 | Okabe et al. | 399/119 |
| 2014/0153973 | A1 | 6/2014 | Takagi et al. | |

FOREIGN PATENT DOCUMENTS

| | | | |
|---|---|---|---|
| JP | 2011-133756 | A | 7/2011 |
| JP | 2011-133763 | A | 7/2011 |

* cited by examiner

*Primary Examiner* — Sophia S Chen
(74) *Attorney, Agent, or Firm* — Banner & Witcoff, Ltd.

(57) ABSTRACT

A development cartridge including a housing, a developer carrying body rotating around a first axis along a first direction, a supply member rotating around a second axis along the first direction, a first gear connected with the developer carrying body, a second gear connected with the supply member, and a gear cover covering the first gear and the second gear, the gear cover including a first cover portion extending in a second direction perpendicular to the first direction, a second cover portion connected with the first cover portion, the second cover portion extending in the first direction, the second cover portion having an opening through which a part of the second gear protrudes from the second cover portion and is exposed.

13 Claims, 9 Drawing Sheets

DEVELOPMENT CARTRIDGE, PROCESS CARTRIDGE, AND IMAGE FORMING APPARATUS HAVING THE SAME

CROSS-REFERENCE TO RELATED APPLICATION

This application claims priority under 35 U.S.C. §119 from Japanese Patent Applications No. 2013-238353 filed on Nov. 18, 2013 and No. 2013-238347 filed on Nov. 18, 2013. The entire subject matters of the applications are incorporated herein by reference.

BACKGROUND

1. Technical Field

The following description relates to aspects of a development cartridge and a process cartridge attached to an electrophotographic image forming apparatus.

2. Related Art

As an electrophotographic image forming apparatus, a printer has been known that includes a development cartridge detachably attached to the printer. The development cartridge includes a development roller and a supply roller.

As an example of the development cartridge, a development cartridge has been known that includes a development gear, a supply gear, and a gear cover configured to collectively cover the development gear and the supply gear. The development gear is disposed at an end portion of a development roller and configured to receive an externally-transmitted driving force. Further, the supply gear is disposed at an end portion of a supply roller and configured to receive an externally-transmitted driving force.

SUMMARY

In the aforementioned development cartridge, the gear cover collectively covers the development gear and the supply gear. Therefore, the gear cover needs to be large in size. Thus, the development cartridge is as well required to be large in size.

Aspects of the present disclosure are advantageous to provide one or more improved techniques, for a development cartridge, which make it possible to realize miniaturization of the development cartridge with a first gear and a second gear collectively covered.

According to aspects of the present disclosure, a development cartridge is provided, which includes a housing configured to store developer (i.e., development agent) therein, a developer carrying body configured to rotate around a first axis extending in a first direction, a supply member configured to rotate around a second axis along the first axis, and to contact the developer carrying body and supply the developer to the developer carrying body, a first gear connected with an end portion of the developer carrying body, a second gear connected with an end portion of the supply member, and a gear cover configured to cover the first gear and the second gear, the gear cover including a first cover portion extending in a second direction perpendicular to the first direction, and a second cover portion connected with the first cover portion, the second cover portion extending in the first direction, the second cover portion having an opening through which a part of the second gear protrudes from the second cover portion and is exposed.

According to aspects of the present disclosure, further provided is a process cartridge that includes a photoconductive body cartridge, and a development cartridge detachably attached to the photoconductive body cartridge, the development cartridge including a housing configured to store developer therein, a developer carrying body configured to rotate around a first axis extending in a first direction, a supply member configured to rotate around a second axis along the first axis, and to contact the developer carrying body and supply the developer to the developer carrying body, a first gear connected with an end portion of the developer carrying body, a second gear connected with an end portion of the supply member, and a gear cover configured to cover the first gear and the second gear, the gear cover including a first cover portion extending in a second direction perpendicular to the first direction, and a second cover portion connected with the first cover portion, the second cover portion extending in the first direction, the second cover portion having an opening through which a part of the second gear protrudes from the second cover portion and is exposed, the housing including a projection protruding in a direction in which the part of the second gear protrudes from the second cover portion, the projection being disposed adjacent to the second gear in the first direction, the photoconductive body cartridge including a photoconductive body configured to rotate around a rotational axis along the first direction, and a cartridge attachment portion configured such that the development cartridge is attached thereto, the cartridge attachment portion including a bottom portion disposed to face the second gear in a direction in which the part of the second gear protrudes from the second cover portion, the bottom portion having an engagement hole configured such that the projection of the housing of the development cartridge is inserted therethrough.

According to aspects of the present disclosure, further provided is an image forming apparatus that includes a casing having an opening, and a process cartridge configured to be inserted into and removed from the casing through the opening, the process cartridge including a photoconductive body cartridge, and a development cartridge detachably attached to the photoconductive body cartridge, the development cartridge including a housing configured to store developer therein, a developer carrying body configured to rotate around a first axis extending in a first direction, a supply member configured to rotate around a second axis along the first axis, and to contact the developer carrying body and supply the developer to the developer carrying body, a first gear connected with an end portion of the developer carrying body, a second gear connected with an end portion of the supply member, and a gear cover configured to cover the first gear and the second gear, the gear cover including a first cover portion extending in a second direction perpendicular to the first direction, and a second cover portion connected with the first cover portion, the second cover portion extending in the first direction, the second cover portion having an opening through which a part of the second gear protrudes from the second cover portion and is exposed, the housing including a projection protruding in a direction in which the part of the second gear protrudes from the second cover portion, the projection being disposed adjacent to the second gear in the first direction, the photoconductive body cartridge including a photoconductive body configured to rotate around a rotational axis along the first direction, and a cartridge attachment portion configured such that the development cartridge is attached thereto, the cartridge attachment portion including a bottom portion disposed to face the second gear in a direction in which the part of the second gear protrudes from the second cover portion, the bottom portion having an engagement hole configured such that the projection of the housing of the development cartridge is inserted therethrough.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings.

1. General Configuration of Development Cartridge

Figure 1:
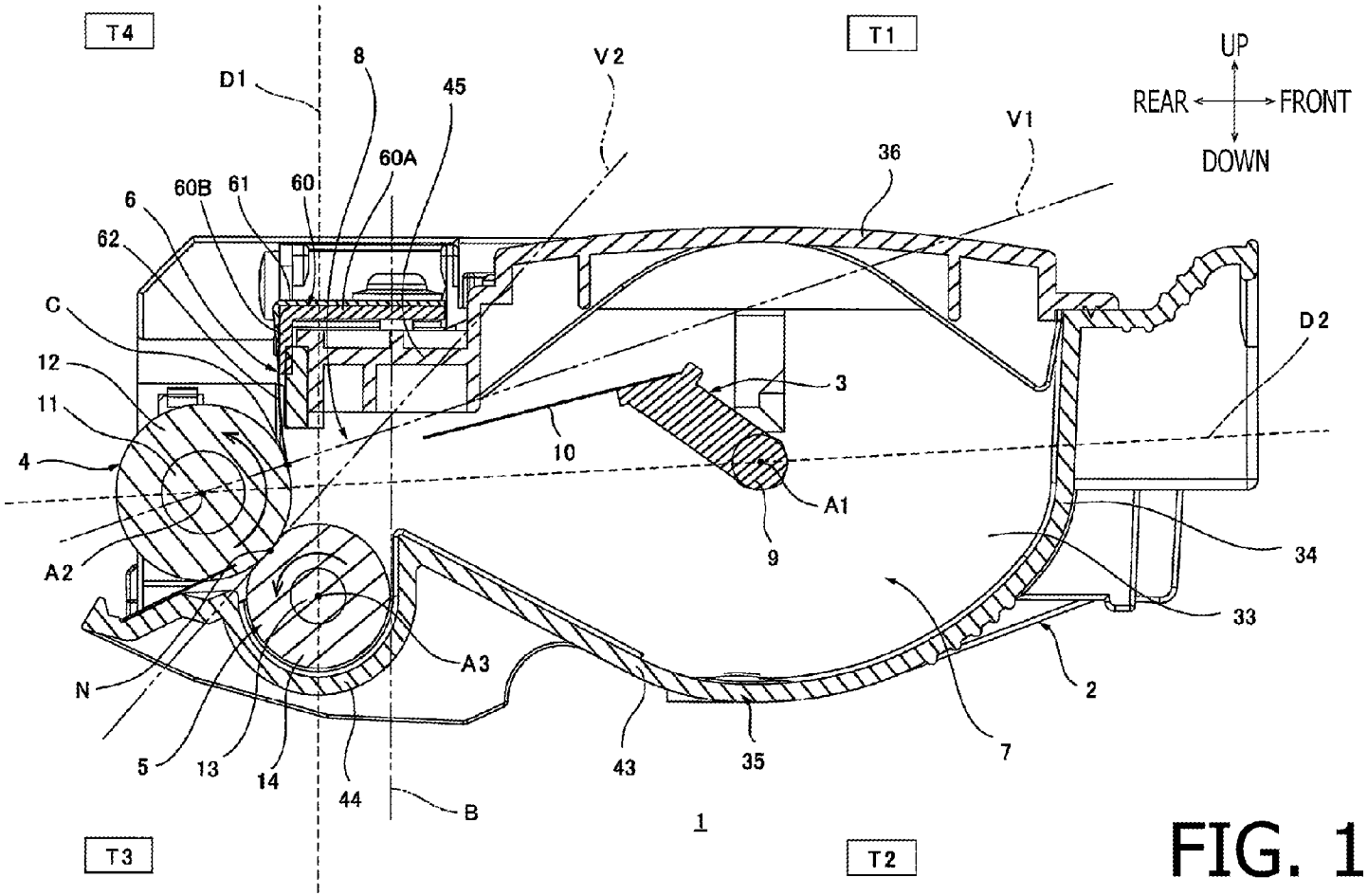
FIG. 1 is a cross-sectional side view of a development cartridge in an illustrative embodiment according to one or more aspects of the present disclosure.

As shown in FIG. 1, a development cartridge 1 includes a development frame 2, an agitator 3, a development roller 4, a supply roller 5, and a layer thickness regulating blade 6.

In the following description, directions of the development cartridge 1 will be defined as shown in the accompany drawings. Specifically, a side at which the development roller 4 is disposed will be defined as a rear side of the development cartridge 1, and an opposite side will be defined as a front side of the development cartridge 1. In other words, a left side on a paper surface of FIG. 1 is the rear side of the development cartridge 1, and a right side on the paper surface of FIG. 1 is the front side of the development cartridge 1. Further, an upside on the paper surface of FIG. 1 is an upper side of the development cartridge 1, and a downside on the paper surface of FIG. 1 is a lower side of the development cartridge 1. Further, a left side and a right side of the development cartridge 1 will be defined on the basis of a front view of the development cartridge 1 (i.e., when the development cartridge 1 is viewed from the front). Specifically, a near side with respect to the paper surface of FIG. 1 is a left side of the development cartridge 1, and a far side with respect to the paper surface of FIG. 1 is a right side of the development cartridge 1.

The development frame 2 is formed substantially in a box shape extending in the left-to-right direction. A rear end portion of the development frame 2 is open in the front-to-rear direction. Further, the development frame 2 includes therein a toner storing chamber 7 and a development chamber 8. The toner storing chamber 7 is configured to store toner.

The agitator 3 is disposed at a substantially middle portion of the toner storing chamber 7 in the front-to-rear direction. The agitator 3 includes an agitator shaft 9 and an agitator blade 10.

The agitator shaft 9 is formed substantially in a cylindrical shape extending in the left-to-right direction. Two end portions of the agitator shaft 9 in the left-to-right direction protrude outward from a below-mentioned left wall 32 and a below-mentioned right wall 33 in the left-to-right direction, respectively.

The agitator blade 10 extends outward from the agitator shaft 9 in a radial direction of the agitator shaft 9.

The agitator 3 is configured to rotate around an agitator rotational axis A1 as a center axis of the agitator shaft 9.

The development roller 4 is disposed at a rear end portion of the development chamber 8. The development roller 4 includes a development roller shaft 11 and a development roller main body 12.

The development roller shaft 11 is made of metal. The development roller shaft 11 is formed substantially in a cylindrical shaft extending in the left-to-right direction. Two end portions of the development roller shaft 11 in the left-to-right direction protrude outward from the below-mentioned left wall 32 and the below-mentioned right wall 33 in the left-to-right direction, respectively.

The development roller main body 12 is made of electrically-conductive rubber. The development roller main body 12 is formed substantially in a cylindrical shape extending in the left-to-right direction. The development roller main body 12 does not cover the two end portions of the development roller shaft 11 in the left-to-right direction, and covers a substantially middle portion of the development roller shaft 11 in the left-to-right direction. Further, an upper portion and a rear portion of the development roller main body 12 are exposed out of the development frame 2.

The development roller 4 is configured to rotate around a development roller rotational axis A2 as a center axis of the development roller shaft 11.

The supply roller 5 is disposed on a lower front side relative to the development roller 4, in the development chamber 8. More specifically, the supply roller 5 is disposed in front of and below the development roller rotational axis A2. The supply roller 5 includes a supply roller shaft 13 and a supply roller main body 14.

The supply roller shaft 13 is made of metal. The supply roller shaft 13 is formed substantially in a cylindrical shape extending in the left-to-right direction. Two end portions of the supply roller shaft 13 in the left-to-right direction protrude from the below-mentioned left wall 32 and the below-mentioned right wall 33 in the left-to-right direction, respectively.

The supply roller main body 14 is made of electrically-conductive sponge. The supply roller main body 14 is formed substantially in a cylindrical shape extending in the left-to-right direction. The supply roller main body 14 does not cover the two end portions of the supply roller shaft 13 in the left-to-right direction, and covers a substantially middle portion of the supply roller shaft 13 in the left-to-right direction. Further, an upper rear end portion of the supply roller main body 14 is in pressure contact with a lower front end portion of the development roller main body 12 of the development roller 4. A diameter of the supply roller main body 14 is smaller than a diameter of the development roller main body 12.

The supply roller 5 is configured to rotate around a supply roller rotational axis A3 as a center axis of the supply roller shaft 13.

The layer thickness regulating blade 6 is disposed on an upper front side relative to the development roller 4, in the development chamber 8. More specifically, the layer thickness regulating blade 6 is disposed in front of and above the development roller rotational axis A2. The layer thickness regulating blade 6 includes a first clamping member 60, a second clamping member 61, and a blade member 62.

The first clamping member 60 is formed substantially in an L-shaped bent plate in a cross-sectional side view, and extends in the left-to-right direction. Specifically, the first clamping member 60 includes a horizontal portion 60A extending in the front-to-rear direction and a vertical portion 60B bending downward from a rear end portion of the horizontal portion 60A. Namely, the vertical portion 60B extends in the vertical direction in a side view.

The second clamping member 61 is disposed on the first clamping member 60. The second clamping member 61 is formed substantially in an L-shaped bent plate in a cross-sectional side view, and extends in the left-to-right direction. Specifically, the second clamping member 61 includes a horizontally-extending portion extending in the front-to-rear direction on the first clamping member 60, and a downward-extending rear end portion that bends downward from a rear end portion of the horizontally-extending portion so as to face a rear end portion of the first clamping member 60 from behind. The rear end portion of the second clamping member 61 is slanted to the front (i.e., slanted to the vertical portion 60B of the first clamping member 60) toward a lower end thereof, so as to clamp the blade member 62.

The blade member 62 is formed substantially in a rectangular plate shape having a longitudinal direction along the left-to-right direction, in a front view. The blade member 62 extends in the vertical direction in a side view. In other words, an extending direction of the blade member 62 is the vertical direction. An upper end portion of the blade member 62 is supported so as to be clamped between the vertical portion 60B of the first clamping member 60 and the rear end portion of the second clamping member 61. A lower end portion of the blade member 62 is in contact with an upper front end portion of the development roller 4.

The toner storing chamber 7 and the development chamber 8 are defined as adjacent different chambers by a boundary line B. The boundary line B is a tangential line that touches a front end of the supply roller main body 14 of the supply roller 5. Further, the boundary line B extends along the vertical direction in which the layer thickness regulating blade 6 extends.

2. Overall Configuration of Printer

Figure 2:
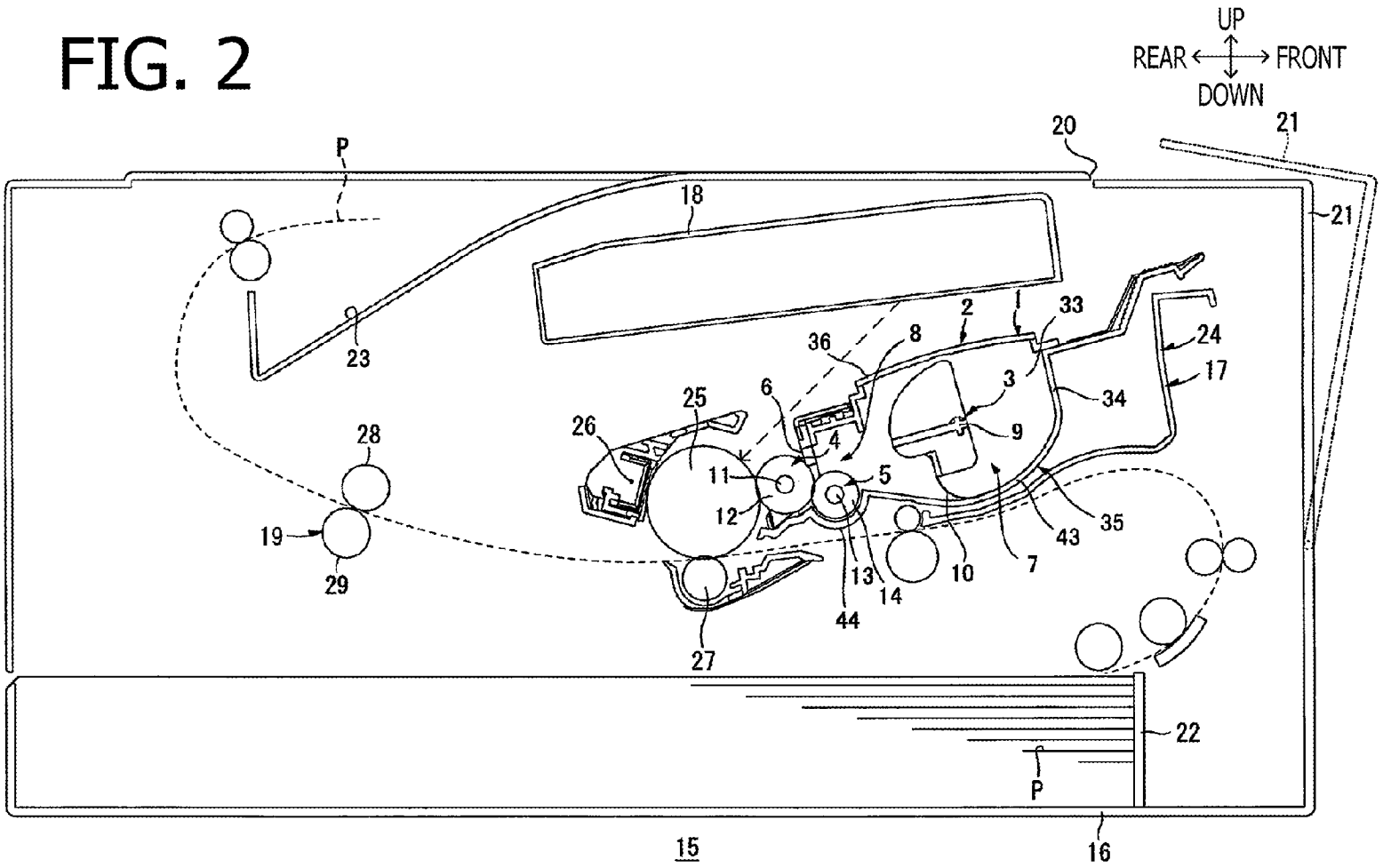
FIG. 2 is a cross-sectional side view of an image forming apparatus with the development cartridge attached thereto in the illustrative embodiment according to one or more aspects of the present disclosure.

The development cartridge 1 configured as above is attached inside the printer 15, as shown in FIG. 2.

The printer 15 is an electrophotographic monochrome printer. The printer 15 includes a main body casing 16, a process cartridge 17, a scanning unit 18, and a fuser unit 19.

The main body casing 16 is formed substantially in a box shape. The main body casing 16 has an opening 20. Further, the main body casing 16 includes a front cover 21, a feed tray 22, and a catch tray 23.

The opening 20 penetrates a front wall of the main body casing 16. The opening 20 is configured to allow the process cartridge 17 to pass through the opening 20.

The front cover 21 is configured to open and close the opening 20.

The feed tray 22 is disposed at a bottom portion of the main body casing 16. The feed tray 22 is configured to support sheets P placed thereon.

The catch tray 23 is disposed on an upper surface of the main body casing 16.

The process cartridge 17 is configured to be inserted into and removed from the main body casing 16 through the opening 20. The process cartridge 17 includes a drum cartridge 24 and the development cartridge 1.

The drum cartridge 24 includes a photoconductive drum 25, a scorotron charger 26, and a transfer roller 27.

The photoconductive drum 25 is disposed at a rear end portion of the drum cartridge 24. The photoconductive drum 25 is formed substantially in a cylindrical shape extending in the left-to-right direction. The photoconductive drum 25 is rotatably supported by a frame of the drum cartridge 24.

The scorotron charger 26 is disposed behind and apart from the photoconductive drum 25.

The transfer roller 27 is disposed under the photoconductive drum 25. The transfer roller 27 is configured to contact a lower end portion of the photoconductive drum 25.

The development cartridge 1 is detachably attached to the drum cartridge 24. Further, when the development cartridge 1 is attached to the drum cartridge 24, a rear end portion of the development roller 4 is brought into contact with a front end portion of the photoconductive drum 25.

The scanning unit 18 is disposed above the process cartridge 17. As indicated by a dashed line in FIG. 2, the scanning unit 18 is configured to emit a laser beam based on image data to the photoconductive drum 25.

The fuser unit 19 is disposed behind the process cartridge 17. The fuser unit 19 includes a heating roller 28 and a pressing roller 29. The pressing roller 29 is disposed on a lower rear side relative to the heating roller 28. The pressing roller 29 is in pressure contact with a lower rear end portion of the heating roller 28.

When the printer starts an image forming operation under control by a controller (not shown), the scorotron charger 26 evenly charges a surface of the photoconductive drum 25. Thereafter, the scanning unit 18 exposes the surface of the photoconductive drum 25. Thereby, an electrostatic latent image based on the image data is formed on the surface of the photoconductive drum 25.

Further, the supply roller 5 supplies the toner stored in the development frame 2 to the development roller 4. Thereby, the toner is positively charged by friction between the development roller 4 and the supply roller 5. Then, the toner is carried on the development roller 4. The layer thickness regulating blade 6 regulates a thickness of the toner carried on the development roller 4 to be constant.

The development roller 4 supplies the toner having a constant thickness to the electrostatic latent image formed on the surface of the photoconductive drum 25. Thereby, a toner image is carried on the surface of the photoconductive drum 25.

By rotation of various rollers, the sheets P are fed from the feed tray 22 to a position between the photoconductive drum 25 and the transfer roller 27, on a sheet-by-sheet basis at respective predetermined moments. The toner image on the photoconductive drum 25 is transferred onto a sheet P, when the sheet P passes between the photoconductive drum 25 and the transfer roller 27.

Afterward, when passing between the heating roller 28 and the pressing roller 29, the sheet P is heated and pressed therebetween. Thereby, the toner image on the sheet P is thermally fixed onto the sheet P. Thereafter, the sheet P is discharged onto the catch tray 23.

3. Details about Development Cartridge

Figure 3A:
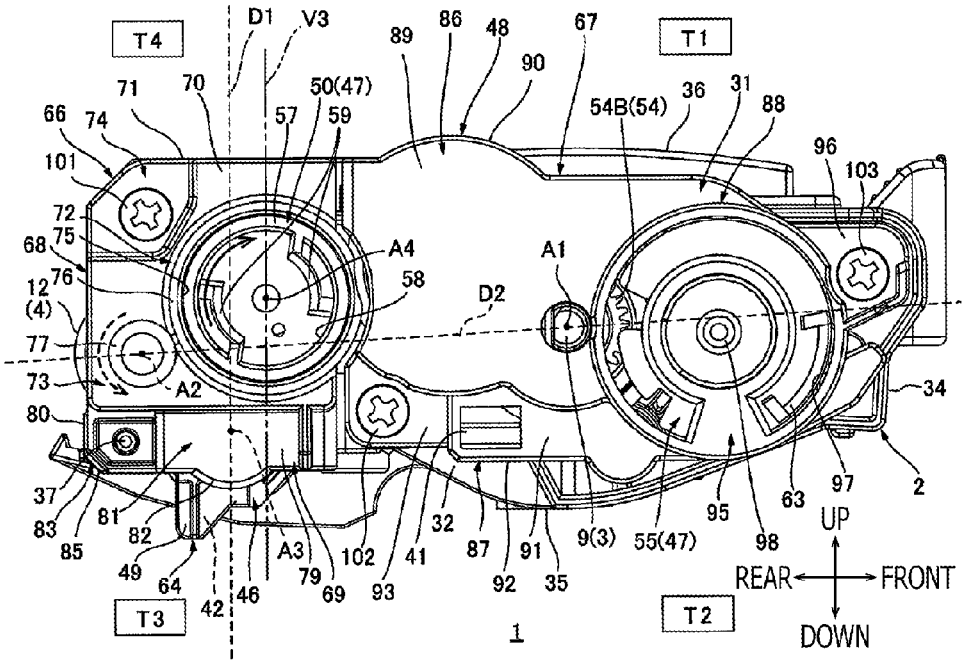
FIG. 3A is a left side view of the development cartridge in the illustrative embodiment according to one or more aspects of the present disclosure.
Figure 4:
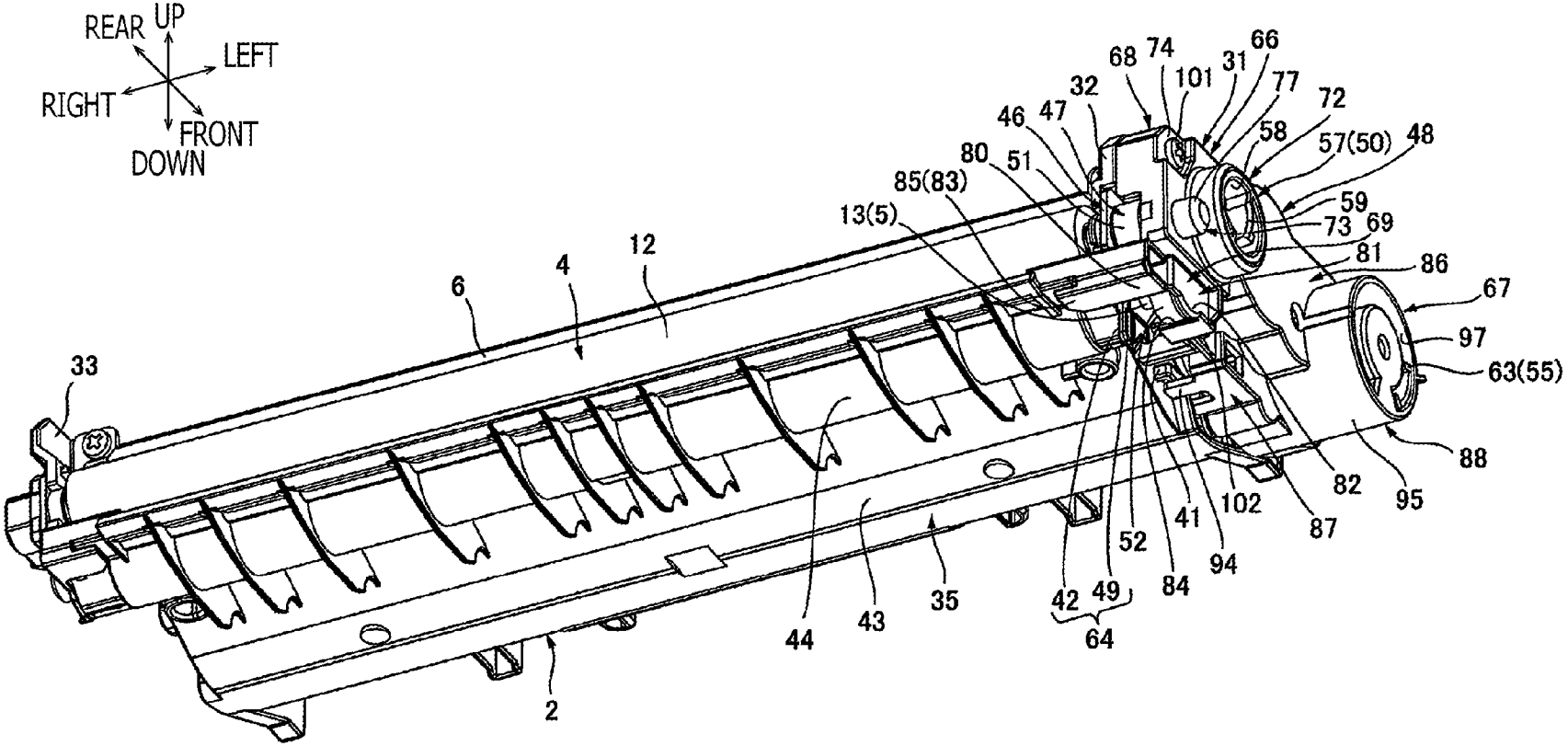
FIG. 4 is a perspective view showing the development cartridge when viewed from a lower left side, in the illustrative embodiment according to one or more aspects of the present disclosure.

As shown in FIGS. 3A and 4, the development cartridge 1 includes the aforementioned development frame 2 and a driving unit 31.

(1) Development Frame

The development frame 2 includes a left wall 32, a right wall 33, a front wall 34, a lower wall 35, and an upper wall 36.

Figure 3B:
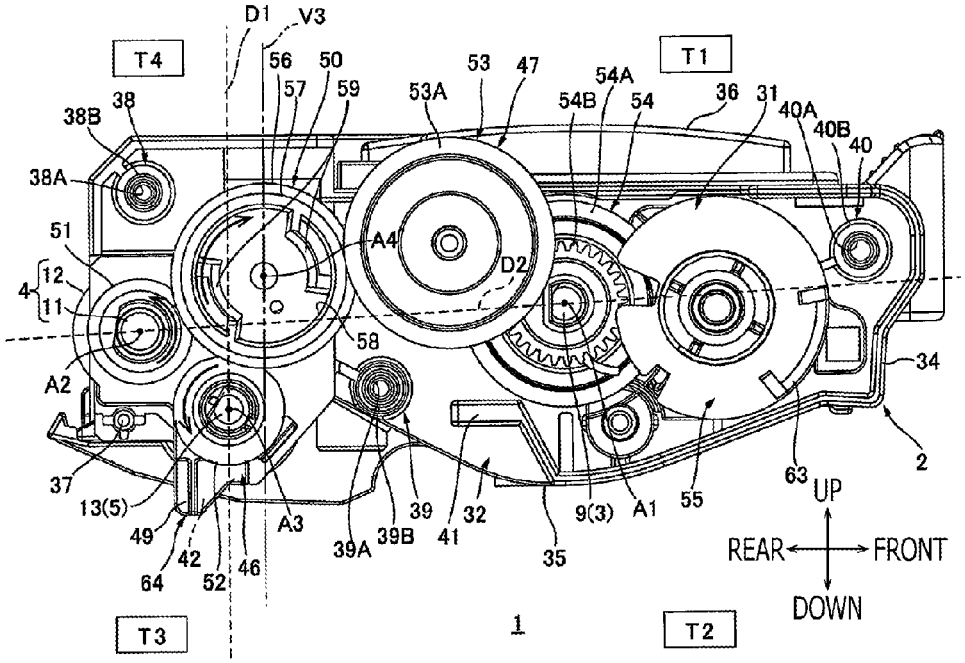
FIG. 3B is a left side view of the development cartridge from which a gear cover is removed, in the illustrative embodiment according to one or more aspects of the present disclosure.
Figure 5:
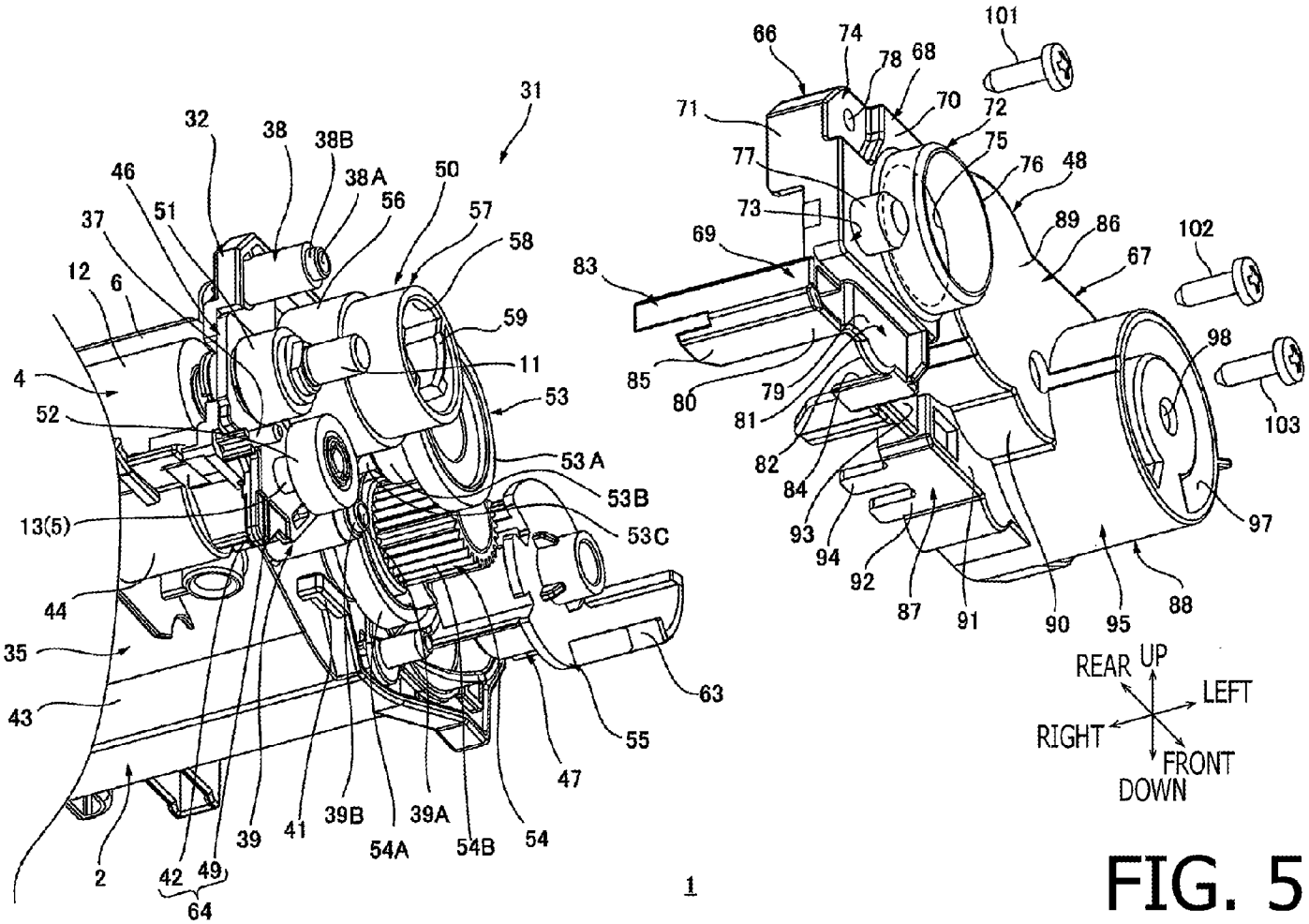
FIG. 5 is an exploded perspective view showing the development cartridge and the gear cover removed from the development cartridge when viewed from a lower left side, in the illustrative embodiment according to one or more aspects of the present disclosure.

The left wall 32 is disposed at a left end portion of the development frame 2. The left wall 32 is formed substantially in a rectangular plate shape extending in the front-to-rear direction, in a side view. As shown in FIGS. 3B and 5, the left wall 32 includes a first screw portion 38, a second screw portion 39, a third screw portion 40, a hook portion 41, a caulking portion 37, and a frame projection 42.

The first screw portion 38 is disposed at an upper rear portion of the left wall 32. The first screw portion 38 is formed substantially in a cylindrical shape protruding leftward from a left surface of the left wall 32. The first screw portion 38 includes a first screw hole 38A and a first engagement portion 38B.

The first screw hole 38A is formed substantially in a circular shape in a side view. The first screw hole 38A is recessed rightward from a left end face of the first screw portion 38.

The first engagement portion 38B is disposed at a left end portion of the first screw portion 38. The first engagement portion 38B is formed substantially in a cylindrical shape extending leftward from a peripheral portion of the first screw hole 38A.

The second screw portion 39 is disposed at a lower end portion of a substantially middle portion of the left wall 32 in the front-to-rear direction. The second screw portion 39 is formed substantially in a cylindrical shape protruding leftward from the left surface of the left wall 32. The second screw portion 39 includes a second screw hole 39A and a second engagement portion 39B.

The second screw hole 39A is formed substantially in a circular shape in a side view. The second screw hole 39A is recessed rightward from a left end face of the second screw portion 39.

The second engagement portion 39B is disposed at a left end portion of the second screw portion 39. The second engagement portion 39B is formed substantially in a cylindrical shape extending leftward from a peripheral portion of the second screw hole 39A.

As shown in FIG. 3B, the third screw portion 40 is disposed at an upper front end portion of the left wall 32. The third screw portion 40 is formed substantially in a cylindrical shape protruding leftward from the left surface of the left wall 32. The third screw portion 40 includes a third screw hole 40A and a third engagement portion 40B.

The third screw hole 40A is formed substantially in a circular shape in a side view. The third screw hole 40A is recessed rightward from a left end face of the third screw portion 40.

The third engagement portion 40B is disposed at a left end portion of the third screw portion 40. The second engagement portion 40B is formed substantially in a cylindrical shape extending leftward from a peripheral portion of the third screw hole 40A.

As shown in FIGS. 3B and 5, the caulking portion 37 is disposed at a lower rear end portion of the left wall 32. The caulking portion 37 is formed substantially in a cylindrical shape protruding leftward from the left surface of the left wall 32.

The hook portion 41 is disposed at a substantially middle portion of the left wall 32 in the front-to-rear direction, on a lower front side relative to the second screw portion 39. The hook portion 41 is formed substantially in a U-shaped plate in a bottom view.

The frame projection 42 is disposed between the caulking portion 37 and the second screw portion 39, on the left wall 32. The frame projection 42 is formed substantially in a rectangular plate shape protruding downward from a lower end portion of the left wall 32, in a side view. It is noted that the frame projection 42, together with a below-mentioned bearing projection 49, forms an engagement projection 64.

Figure 7:
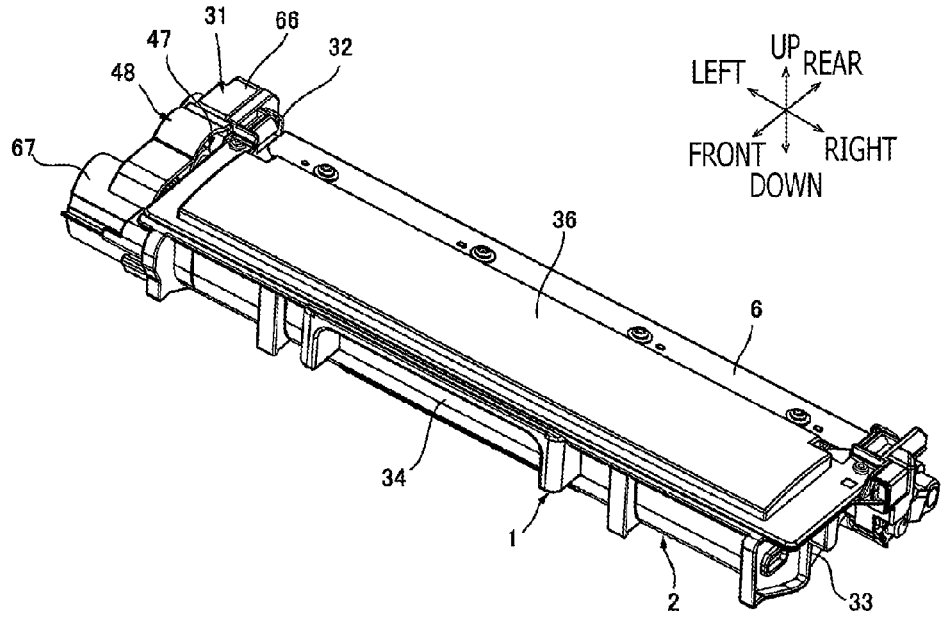
FIG. 7 is a perspective view showing a drum cartridge and the development cartridge when viewed from an upper right side to illustrate how the development cartridge is attached to the drum cartridge, in the illustrative embodiment according to one or more aspects of the present disclosure.
Figure 7:
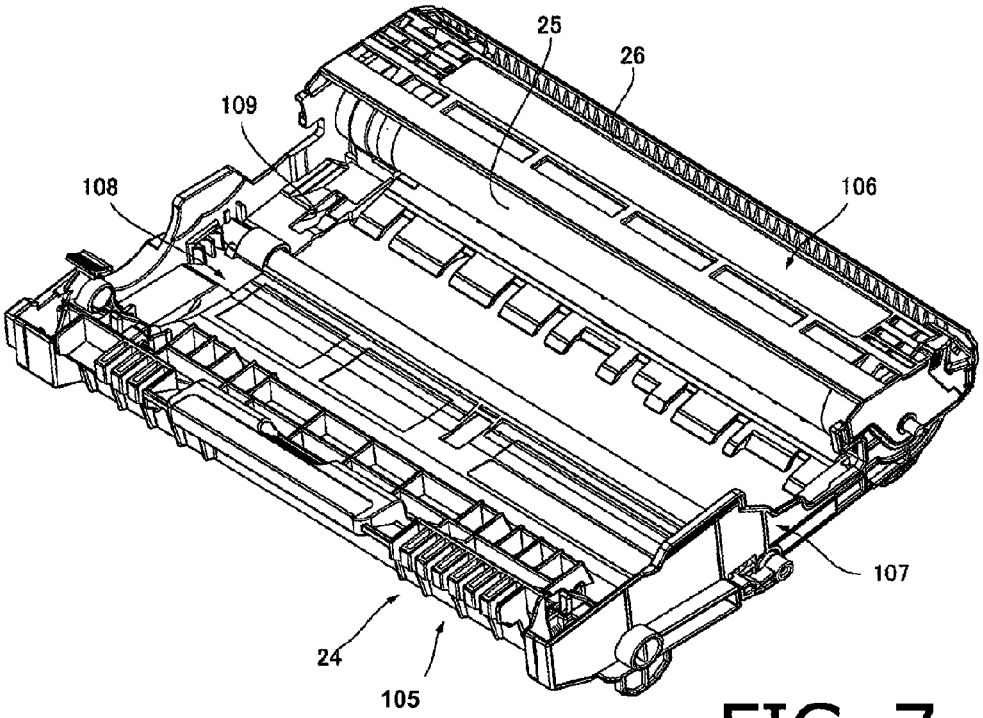

As shown in FIGS. 1 and 7, the right wall 33 is disposed at a right end portion of the development frame 2. In the same manner as the left wall 32, the right wall 33 is formed substantially in a rectangular plate shape extending in the front-to-rear direction, in a side view.

The front wall 34 is configured to bridge a distance between a front end portion of the left wall 32 and a front end portion of the right wall 33. The front wall 34 is formed substantially in a plate shape extending in the left-to-right direction.

As shown in FIGS. 1 and 4, the lower wall 35 is configured to bridge a distance between a lower end portion of the left wall 32 and a lower end portion of the right wall 33. The lower wall 35 is formed substantially in a plate shape extending in a curved manner rearward from a lower end portion of the front wall 34. The lower wall 35 includes a curved wall 43 and a bent wall 44.

The curved wall 43 extends rearward continuously from a lower end portion of the front wall 34, over a range from a substantially central portion to a front portion of the lower wall 35. The curved wall 43 is formed substantially in an arc shape along a rotational trajectory of the agitator 3, in a cross-sectional side view.

The bent wall 44 is formed substantially in a W-shape that extends rearward continuously from a rear end portion of the curved wall 43 at a rear portion of the lower wall 35, in a cross-sectional side view. A front portion of the bent wall 44 is formed substantially in an arc shape along a rotational trajectory of the supply roller 5. A rear portion of the bent wall 44 extends rearward.

As shown in FIGS. 1 and 7, the upper wall 36 is disposed above an upper end portion of the left wall 32, an upper end portion of the right wall 33, and an upper end portion of the front wall 34. The upper wall is formed substantially in a plate shape extending in the left-to-right direction. The upper wall 36 includes a blade supporting wall 45.

The blade supporting wall 45 is configured to support the layer thickness regulating blade 6. The blade supporting wall 45 is disposed at a rear end portion of the upper wall 36. The blade supporting wall 45 is formed substantially in a rectangular plate shape extending in the left-to-right direction, in a plane view. A rear surface of the blade supporting wall 45 extends in the vertical direction in a side view. Namely, the rear surface of the blade supporting wall 45 extends in the same direction as the extending direction of the layer thickness regulating blade 6.

A peripheral portion of the upper wall 36 other than the blade supporting wall 45 is fixed, by a method such as welding, to the upper end portion of the left wall 32, the upper end portion of the right wall 33, and the upper end portion of the front wall 34.

(2) Detailed Dispositions of Development Roller, Supply Roller, Layer Thickness Regulating Blade, and Agitator Subsequently, referring to FIG. 1, explanations will be provided about detailed dispositions of the agitator 3, the development roller 4, the supply roller 5, and the layer thickness regulating blade 6.

As described above, the agitator 3 is disposed at the substantially middle portion of the toner storing chamber 7 in the front-to-rear direction. The development roller 4 is disposed at the rear end portion of the development chamber 8. The supply roller 5 is disposed on the lower front side relative to the development roller 4, in the development chamber 8. The layer thickness regulating blade 6 is disposed on the upper front side relative to the development roller 4, in the development chamber 8.

A first partition line D1 is defined as a virtual line extending along the vertical direction and passing through the supply roller rotational axis A3. Further, a second partition line D2 is defined as a virtual line passing through the development roller rotational axis A2 and the agitator rotational axis A1. In other words, the second partition line D2 is along an extending direction of the vertical portion 60B of the first clamping member 60 that contacts the blade member 62.

Moreover, of areas sectioned by the first partition line D1 and the second partition line D2, an upper front area is defined as a first quadrant T1, a lower front area is defined as a second quadrant T2, a lower rear area is defined as a third quadrant T3, and an upper rear area is defined as a fourth quadrant T4.

Further, in a side view, a nipping point N between the development roller main body 12 and the supply roller main body 14 is defined as a point where a straight line (not shown) connecting the development roller rotational axis A2 with the supply roller rotational axis A3 intersects a circumferential surface of the development roller main body 12 of the development roller 4. Additionally, a first virtual line V1 is defined as a line passing through the development roller rotational axis A2 and a contact point C between the development roller main body 12 of the development roller 4 and the layer thickness regulating blade 6. A second virtual line V2 is defined as a tangential line that touches the development roller main body 12 of the development roller 4 and passes through the nipping point N.

At this time, the agitator 3, the development roller 4, the supply roller 5, and the layer thickness regulating blade 6 are supported by the development frame 2, in respective positions such that the first virtual line V1 and the second virtual line V2 intersect each other in the first quadrant T1.

Further, the layer thickness regulating blade 6 is disposed between the development roller 4 and the blade supporting wall 45 of the development frame 2.

(3) Driving Unit

As shown in FIGS. 3B and 5, the driving unit 31 includes a bearing member 46, a gear train 47, and a gear cover 48.

(3-1) Bearing Member

The bearing member 46 is formed substantially in a rectangular plate shape in a side view. The bearing member 46 is attached to the left surface of the left wall 32. The bearing member 46 is configured to rotatably support a left end portion of the supply roller shaft 13 and rotatably support a left end portion of the development roller shaft 11. Namely, the respective left end portions of the supply roller shaft 13 and the development roller shaft 11 are supported to be rotatable relative to the left wall 32 via the bearing member 46. Further, the respective left end portions of the supply roller shaft 13 and the development roller shaft 11 protrude leftward from the bearing member 46. In addition, the bearing member 46 includes a bearing projection 49.

The bearing projection 49 is formed substantially in a rectangular plate shape protruding downward from a lower end portion of the bearing member 46, in a side view. When projected in the left-to-right direction, an external form of the bearing projection 49 is coincident with an external form of the frame projection 42 of the left wall 32. A right surface of the bearing projection 49 is in contact with a left surface of the frame projection 42. Thereby, the bearing projection 49 and the frame projection 42 form the engagement projection 64 that protrudes downward from the development cartridge 1.

(3-2) Gear Train

The gear train 47 is disposed at a left portion of the left wall 32. The gear train 47 includes a development coupling 50, a development gear 51, a supply gear 52, an idle gear 53, an agitator gear 54, and a detection gear 55.

(3-2-1) Development Coupling

The development coupling 50 is disposed at a rear portion of the left surface of the left wall 32. The development coupling 50 is configured to transmit a driving force from a driving source (not shown) to the agitator 3, the development roller 4, and the supply roller 5. The development coupling 50 is supported to be rotatable around a shaft (not shown) extending in the left-to-right direction. The shaft is fixed to the left wall 32 to be un-rotatable relative to the left wall 32. A rotational axis of the development coupling 50 is defined as a coupling rotational axis A4. The development coupling 50 is formed substantially in a cylindrical shape extending in the left-to-right direction. The development coupling 50 is provided integrally with a coupling gear 56 and a coupling portion 57.

The coupling gear 56 is a right part of the development coupling 50. The coupling gear 56 includes gear teeth provided all over a circumferential surface thereof.

The coupling portion 57 is a left part of the development coupling 50. The coupling portion 57 is formed substantially in a cylindrical shape that has a rotational axis positionally coincident with a rotational axis of the coupling gear 56. Further, an outer diameter of the coupling portion 57 is smaller than an outer diameter of the coupling gear 56. The coupling portion 57 includes a recessed portion 58 and two projections 59.

The recessed portion 58 is recessed rightward from a left end face of the coupling portion 57, substantially in a circular shape in a side view.

Each of the two projections 59 protrudes inward from an inner circumferential surface of the recessed portion 58 in a radial direction of the recessed portion 58. The two projections 59 are disposed to face each other in the radial direction of the recessed portion 58. Each of the two projections 59 is formed substantially in a rectangular column shape extending in the left-to-right direction.

As shown in FIGS. 3A and 3B, when a third virtual line V3 is defined as a straight line that extends in the vertical direction and passes through the coupling rotational axis A4, the supply roller shaft 13 is disposed behind the third virtual line V3.

(3-2-2) Development Gear

As shown in FIGS. 3B and 5, the development gear 51 is configured to transmit a driving force from the driving source (not shown) to the development roller 4 via the development coupling 50. The development gear 51 is disposed behind the development coupling 50. The development gear 51 is formed substantially in a cylindrical shape extending in the left-to-right direction. The development gear 51 includes gear teeth all over a circumferential surface thereof. The development gear 51 is attached to a left end portion of the development roller shaft 11 to be un-rotatable relative to the development roller shaft 11. Further, a front end portion of the development gear 51 engages with a right part of a rear end portion of the coupling gear 56 of the development coupling 50.

(3-2-3) Supply Gear

Figure 6:
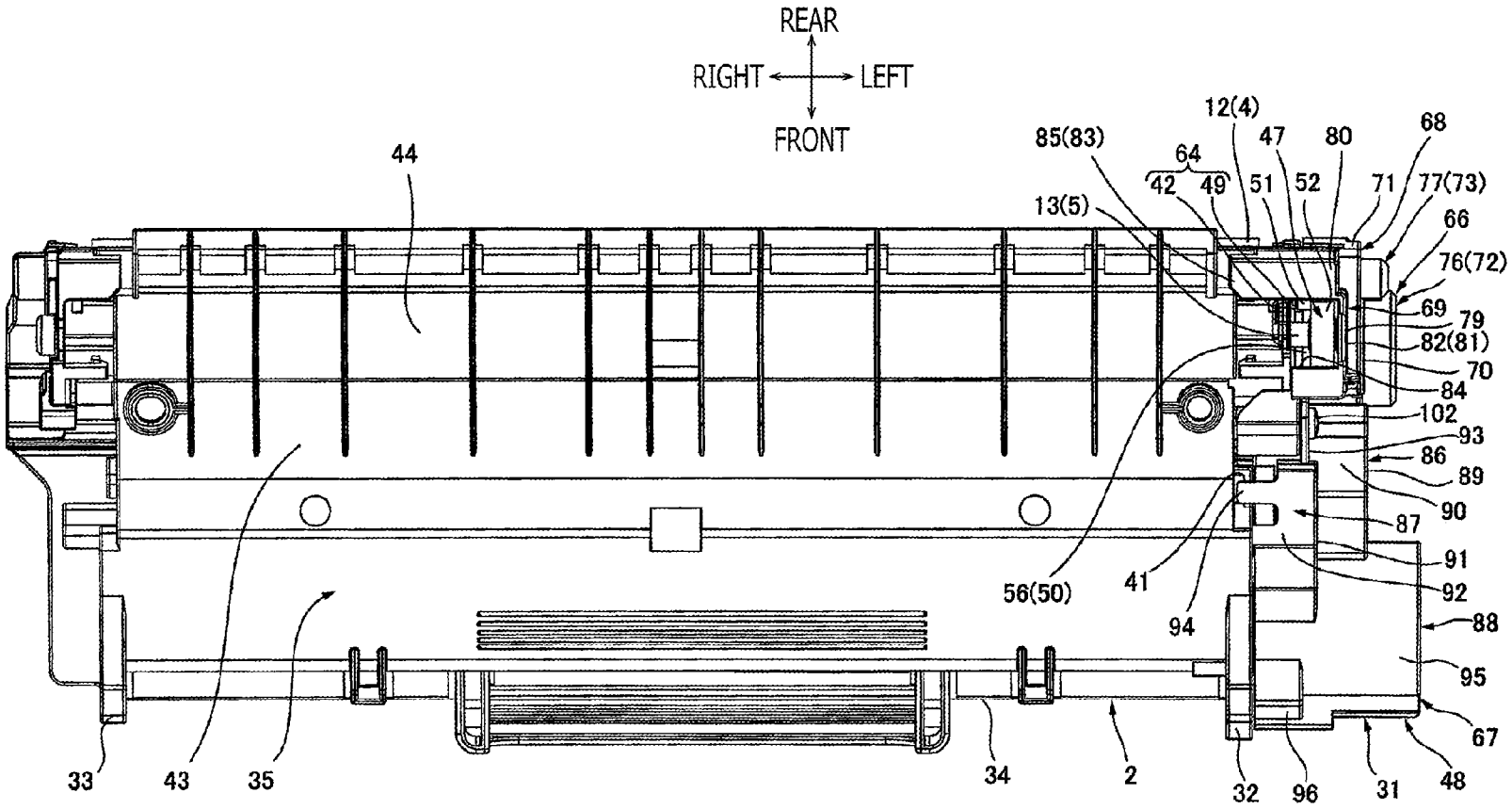
FIG. 6 is a bottom view of the development cartridge in the illustrative embodiment according to one or more aspects of the present disclosure.

The supply gear 52 is configured to transmit a driving force from the driving source (not shown) to the supply roller 5 via the development coupling 50. The supply gear 52 is disposed adjacent to a left side of the bearing projection 49, on a lower rear side relative to the development coupling 50. The supply gear 52 is formed substantially in a cylindrical shape extending in the left-to-right direction. The supply gear 52 includes gear teeth over an entire circumferential surface thereof. The supply gear 52 is attached to a left end portion of the supply roller shaft 13 to be un-rotatable relative to the supply roller shaft 13. Further, an upper front end portion of the supply gear 52 engages with a substantially middle portion, in the left-to-right direction, of a lower rear end portion of the coupling gear 56. Namely, as shown in FIG. 6, the supply gear 52 engages with a portion of the coupling gear 56 that is positionally different in the left-to-right direction from a portion of the coupling gear 56 that engages with the development gear 51. In other words, an engagement portion between the coupling gear 56 and the development gear 51 is in a different position in the left-to-right direction from an engagement portion between the coupling gear 56 and the supply gear 52.

(3-2-4) Idle Gear

As shown in FIGS. 3B and 5, the idle gear 53 is disposed in front of the development coupling 50. The idle gear 53 is supported to be rotatable around a shaft (not shown) extending in the left-to-right direction. The shaft is fixed to the left wall 32 to be un-rotatable relative to the left wall 32. The idle gear 53 is provided integrally with an idle large-diameter gear 53A, an idle medium-diameter portion 53B, and an idle small-diameter gear 53C.

The idle large-diameter gear 53A is a left part of the idle gear 53. The idle large-diameter gear 53A is formed substantially in a circular ring shape having a thickness in the left-to-right direction. The idle large-diameter gear 53A includes gear teeth over an entire circumferential surface thereof. A rear end portion of the idle large-diameter gear 53A engages with a front end portion of the coupling gear 56 of the development coupling 50.

The idle medium-diameter portion 53B is a substantially middle part of the idle gear 53 in the left-to-right direction. The idle medium-diameter portion 53B protrudes rightward from a right surface of the idle large-diameter gear 53A. The idle medium-diameter portion 53B is formed substantially in a cylindrical shape having a closed right end. An outer diameter of the idle medium-diameter portion 53B is smaller than an outer diameter of the idle large-diameter gear 53A. An inner diameter of the idle medium-diameter portion 53B is as large as an inner diameter of the idle large-diameter gear 53A.

The idle small-diameter gear 53C is a right part of the idle gear 53. The idle small-diameter gear 53C is formed substantially in a cylindrical shape extending rightward from a right surface of the idle medium-diameter portion 53B. An outer diameter of the idle small-diameter gear 53C is smaller than the inner diameter of the idle medium-diameter portion. An inner diameter of the idle small-diameter gear 53C is slightly larger than an outer diameter of the shaft (not shown) of the idle gear 53. The idle small-diameter gear 53C includes gear teeth over an entire circumferential surface thereof.

In the idle gear 53, respective rotational axes of the idle large-diameter gear 53A, the idle medium-diameter portion 53B, and the idle small-diameter gear 53C are positionally coincident with each other.

(3-2-5) Agitator Gear

The agitator gear 54 is disposed on a lower front side relative to the idle gear 53. The agitator gear 54 is fixed to a left end portion of the agitator shaft 9 to be un-rotatable relative to the agitator shaft 9. The agitator gear 54 is provided integrally with an agitator large-diameter gear 54A and an agitator small-diameter gear 54B.

The agitator large-diameter gear 54A is a right part of the agitator gear 54. The agitator large-diameter gear 54A is formed substantially in a circular ring shape having a thickness in the left-to-right direction. The agitator large-diameter gear 54A includes gear teeth over an entire circumferential surface thereof. An upper rear end portion of the agitator large-diameter gear 54A engages with a lower front end portion of the idle small-diameter gear 53C.

The agitator small-diameter gear 54B is a left part of the agitator gear 54. The agitator small-diameter gear 54B is formed substantially in a cylindrical shape that has a rotational axis positionally coincident with a rotational axis of the agitator large-diameter gear MA. Further, an outer diameter of the agitator small-diameter gear MB is smaller than an outer diameter of the agitator large-diameter gear MA. An inner diameter of the agitator small-diameter gear MB is as large as an inner diameter of the agitator large-diameter gear MA. The agitator small-diameter gear MB includes gear teeth over an entire circumferential surface thereof.

(3-2-6) Detection Gear

The detection gear 55 is disposed in front of the agitator gear 54. The detection gear 55 is supported to be rotatable around a shaft (not shown). The shaft extends in the left-to-right direction from a cap for closing a toner filling opening (not shown) of the left wall 32. The detection gear 55 is formed substantially in a cylindrical shape that extends in the left-to-right direction and has a closed left end. The detection gear 55 includes gear teeth over half a circumferential surface thereof. Namely, the detection gear 55 is a tooth-missing gear. Further, a rear end portion of the detection gear 55 is configured to engage with a front end portion of the agitator small-diameter gear 54B of the agitator gear 54. The detection gear 55 includes a contact portion 63.

The contact portion 63 protrudes leftward from a left end face of the detection gear 55. The contact portion 63 extends over an angle range of 60 degrees in a circumferential direction of the detection gear 55. The contact portion 63 is formed substantially in a curved plate shape.

(3-3) Gear Cover

The gear cover 48 is attached to the left wall 32 so as to entirely cover the gear train 47. As shown in FIGS. 3A and 5, the gear cover 48 is provided integrally with a rear cover 66 and a front cover 67.

(3-3-1) Rear Cover

The rear cover 66 is a rear part of the gear cover 48. The rear cover 66 is provided integrally with a first portion 68 and a second portion 69.

The first portion 68 is an upper part of the rear cover 66. The first portion 68 is provided integrally with a first base plate 70 and a first peripheral wall 71 that protrudes rightward from a peripheral end portion of the first base plate 70. Namely, the first portion 68 is formed substantially in a box shape having an open right end and a closed left end. Further, the first portion 68 includes a coupling cover portion 72, a development roller cover portion 73, and a first fixed portion 74.

The coupling cover portion 72 is disposed at a substantially middle part of the first base plate 70 in the vertical direction and the front-to-rear direction. The coupling cover portion 72 includes a drive input opening 75 and a cylinder portion 76.

The drive input opening 75 penetrates the first base plate 70, and is formed substantially in a circular shape in a side view.

The cylinder portion 76 is formed substantially in a cylindrical shape that extends leftward from a left surface of the first base plate 70 at a peripheral portion of the drive input opening 75. An inner diameter of the cylinder portion 76 is as large as a diameter of the drive input opening 75. Further, a dimension of the cylinder portion 76 in the left-to-right direction is as large as a dimension, in the left-to-right direction, of the coupling portion 57 of the development coupling 50.

The development roller cover portion 73 is disposed at a rear end portion of a substantially middle part of the first base plate 70 in the vertical direction, behind the coupling cover portion 72. The development roller cover portion 73 includes a color portion 77.

The color portion 77 is formed substantially in a cylindrical shape that extends in the left-to-right direction and has a closed left end. An inner diameter of the color portion 77 is slightly larger than an outer diameter of the development roller shaft 11.

The first fixed portion 74 is disposed at an upper rear end portion of the first base plate 70, above the development roller cover portion 73. The first fixed portion 74 is slightly recessed rightward from the development roller cover portion 73. The first fixed portion 74 has a first insertion hole 78.

The first insertion hole 78 penetrates the first base plate 70, and is formed substantially in a circular shape in a side view. An inner diameter of the first insertion hole 78 is slightly larger than the first engagement portion 38B of the first screw portion 38.

The second portion 69 is a lower part of the rear cover 66. The second portion 69 is disposed below the first portion 68 so as to be continuous from a right end portion of the first peripheral wall 71. Namely, the second portion 69 is disposed on a right side relative to the first base plate 70 of the first portion 68. The second portion 69 is provided integrally with a second base plate 79 and a second peripheral wall 80. The second peripheral wall 80 protrudes rightward from a peripheral end portion of the second base plate 79. Namely, the second portion 69 is formed substantially in a box shape having an open right end and a closed left end. The second portion 69 includes a supply roller cover portion 81, a locking portion 83, and a cutout portion 84.

The supply roller cover portion 81 is disposed at a substantially middle portion of the second base plate 79 in the front-to-rear direction, below the coupling cover portion 72. The supply roller cover portion 81 includes a semicircular portion 82.

The semicircular portion 82 is formed substantially in a semicircular shape protruding downward from the supply roller cover portion 81, in a side view. A radius of an arc of the semicircular portion 82 is slightly larger than a radius of the supply gear 52.

In a state where the gear cover 48 is attached to the left wall 32, when the supply roller cover portion 81 is projected in the left-to-right direction, the semicircular portion 82 protrudes downward from the supply gear 52.

Thereby, the supply roller cover portion 81 is configured to entirely cover a left surface of the supply gear 52 from the left. It is noted that the supply roller cover portion 81 and the development roller cover portion 73 are configured to cover the supply gear 52 and the development gear 51 from the left.

The lock portion 83 is disposed at a rear end portion of the second base plate 79, below the development roller cover portion 73, behind the supply roller cover portion 81. The lock portion 83 is formed substantially in a bottomed-frame shape having a closed right end. The lock portion 83 has a lock insertion hole (not shown) that penetrates a right end portion of the lock portion 83, and is formed substantially in a circular shape in a side view.

Further, the lock portion 83 includes a protection wall 85.

The protection wall 85 is formed substantially in an L-shaped plate protruding leftward from a lower right end portion and a front right end portion of the lock portion 83, in a side view.

As shown in FIGS. 5 and 6, the cutout portion 84 is formed by cutting out a specific portion that is a lower portion of the supply roller cover portion 81 and a substantially middle portion, in the front-to-rear direction, of a lower portion of the second peripheral wall 80. In other words, the cutout portion 84 is defined as a space that is below the supply roller cover portion 81 and in front of the lock portion 83.

(3-3-2) Front Cover

As shown in FIGS. 3A and 5, the front cover 67 extends forward continuously from a front end portion of the rear cover 66, and forms a front part of the gear cover 48. The front cover 67 is provided integrally with a third portion 86, a fourth portion 87, and a fifth portion 88.

The third portion 86 is an upper rear part of the front cover 67. The third portion 86 is provided integrally with a third base plate 89 and a third peripheral wall 90 that protrudes rightward from a peripheral end portion of the third base plate 89. Namely, the third portion 86 is formed substantially in a box shape having an open right end and a closed left end. Although the following state is not shown in any drawings, in the state where the gear cover 48 is attached to the left wall 32, the third portion 86 is inserted into the idle gear 53 and supports an idle gear supporter configured to pivotally support the idle gear 53.

The fourth portion 87 is a lower rear part of the front cover 67. The fourth portion 87 is disposed below the third portion 86 so as to be continuous from a right end portion of the third peripheral wall 90. Namely, the fourth portion 87 is disposed on a right side relative to the third base plate 89 of the third portion 86. The fourth portion 87 includes a fourth base plate 91 and a fourth peripheral wall 92 that protrudes rightward from a lower end portion of the fourth base plate 91. Namely, the fourth portion 87 is formed substantially in a L-shaped plate in a cross-sectional front view. The fourth portion 87 further includes a second fixed portion 93 and a locking claw 94.

The second fixed portion 93 is disposed at a rear end portion of the fourth base plate 91. The second fixed portion 93 has a second insertion hole (not shown) that penetrates the second fixed portion 93, and is formed substantially in a circular shape in a side view. An inner diameter of the second insertion hole (not shown) is slightly larger than an outer diameter of the second engagement portion 39B of the second screw portion 39.

The locking claw 94 is formed substantially in a hook shape that protrudes rightward from a right end portion of a substantially middle portion of the fourth peripheral wall 92 in the front-to-rear direction and is bent upward from a right end portion of the protrusion.

The fifth portion 88 is a front part of the front cover 67. The fifth portion 88 protrudes leftward continuously from front end portions of the third portion 86 and the fourth portion 87. The fifth portion 88 includes a detection gear cover portion 95 and a third fixed portion 96.

The detection gear cover portion 95 is formed substantially in a cylindrical shape that protrudes leftward continuously from the front end portions of the third portion 86 and the fourth portion 87 and has a closed left end. Namely, a left end portion of the detection gear cover portion 95 is positioned on a left side relative to the third portion 86 and the fourth portion 87. The detection gear cover portion 95 includes a contact-portion opening 97 and a detection gear regulating portion 98.

The contact-portion opening 97 penetrates a left end wall of the detection gear cover portion 95, and is formed substantially in a C-shape having an open lower end in a side view. Thereby, the contact-portion opening 97 is configured such that the contact portion 63 of the detection gear 55 protrudes therethrough.

The detection gear regulating portion 98 is formed substantially in a cylindrical shape protruding rightward from a central part of a right surface of a right wall of the detection gear cover portion 95. An outer diameter of the detection gear regulating portion 98 is slightly smaller than an inner diameter of the detection gear 55.

As shown in FIG. 3A, the third fixed portion 96 protrudes forward from an upper right end portion of a front part of the detection gear cover portion 95. The third fixed portion 96 is formed substantially in a box shape having an open right end and a left closed end. Further, a left end wall of the third fixed portion 96 is positioned on a right side relative to the third base plate 89 and substantially in plane with (a left end face of) the fourth base plate 91. The third fixed portion 96 has a third insertion hole (not shown) that penetrates the first fixed portion 96, and is formed substantially in a circular shape in a side view. An inner diameter of the third insertion hole (not shown) is slightly larger than an outer diameter of the third engagement portion 40B of the third screw portion 40.

4. Attaching Gear Cover to Development Frame and Detaching Gear Cover from Development Frame The gear cover 48 configured as above is attached by an operator to the development frame 2.

In order to attach the gear cover 48 to the development frame 2, as shown in FIGS. 4 and 5, first, the gear cover 48 is attached to the left wall 32 having the gear train 47 attached thereto, from the left. More specifically, in the rear cover 66, the color portion 77 accepts insertion of the development roller shaft 11 thereinto, and the cylinder portion 76 accepts insertion of the coupling portion 57 thereinto. Further, in the front cover 67, an idle gear supporting portion (not shown) is inserted into the agitator gear 54, and the detection gear regulating portion 98 is inserted into the detection gear 55. Further, the contact-portion opening 97 accepts insertion of the contact portion 63 of the detection gear 55 therethrough.

Thereby, in the rear cover 66, the first insertion hole 78 accepts insertion of the first engagement portion 38B of the first screw portion 38 therethrough. The lock insertion hole (not shown) of the lock portion 83 accepts insertion of the caulking portion 37 therethrough. Further, in the front cover 67, the second insertion hole (not shown) accepts insertion of the second engagement portion 39B of the second screw portion 39 therethrough. The third insertion hole (not shown) accepts insertion of the third engagement portion 40B of the third screw portion 40 therethrough. The locking claw 94 is hooked to the hook portion 41, and locks the hook portion 41.

Thus, the gear cover 48 is attached to the left wall 32 from the left.

Thereby, a left end face of the supply gear 52 and a right surface of the supply roller cover portion 81 are disposed to face each other across a distance. Further, the third base plate 89 covers the idle gear 53 and the agitator gear 54. The detection gear cover portion 95 covers the detection gear 55. The idle gear 53 and the detection gear 55 are rotatably supported by the left wall 32 in such a manner that the rotational axes of the idle gear 53 and the detection gear 55 are not positionally shifted relative to the left wall 32.

Subsequently, a first screw member 101 is screwed into the first screw hole 38A via the first insertion hole 78. A second screw member 102 is screwed into the second screw hole 39A via the second insertion hole (not shown) of the second fixed portion 93. A third screw member 103 is screwed into the third screw hole 40A via the third insertion hole (not shown) of the third fixed portion 96.

Thus, the gear cover 48 is attached to the left wall 32 with the rear cover 66 covering the development coupling 50, the development gear 51, and the supply gear 52, and the front cover 67 covering the agitator gear 54 and the detection gear 55.

As shown in FIGS. 4 and 6, in a view from a lower side, a lower end portion of the supply gear 52 is exposed through the cutout portion 84 of the supply roller cover portion 81 and protrudes downward from the cutout portion 84.

In the above procedure, the development cartridge 1 is completely attached inside the printer 15.

Further, the gear cover 48 is detached from the left wall 32 in a reverse procedure of the aforementioned procedure.

Specifically, first, the first screw member 101 is removed from the first screw hole 38A. The second screw member 102 is removed from the second screw hole 39A. The third screw member 103 is removed from the third screw hole 40A.

Then, when the locking state where the locking claw 94 is hooked to the hook portion 41 is released, and the gear cover 48 is moved leftward, the gear cover 48 is detached from the left wall 32.

Thus, the gear cover 48 is completely removed from the left wall 32.

5. Details about Process Cartridge

The process cartridge 17 is configured with the development cartridge 1 attached to the drum cartridge 24.

Figure 8:
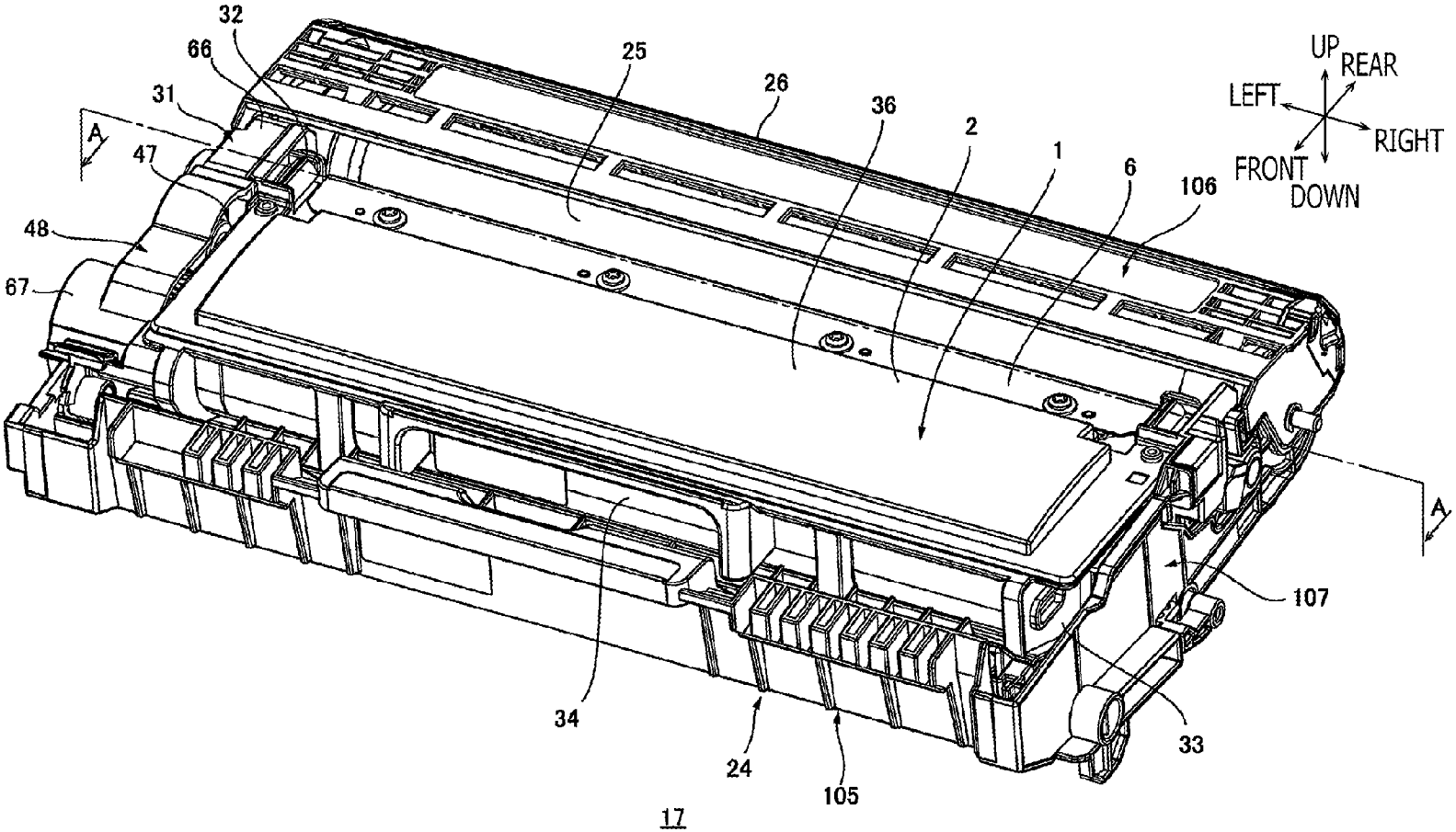
FIG. 8 is a perspective view showing a process cartridge when viewed from an upper right side, in the illustrative embodiment according to one or more aspects of the present disclosure.

As shown in FIGS. 7 and 8, the drum cartridge 24 includes a drum frame 105, the aforementioned photoconductive drum 25, and the aforementioned scorotron charger 26.

The drum frame 105 is formed substantially in a shape of a rectangular bottomed frame having a closed lower end. The drum frame 105 includes a drum container 106 as a rear part of the drum frame 105, and a development cartridge attachment portion 107 as a front part of the drum frame 105.

The drum container 106 is configured to support the photoconductive drum 25 and the scorotron charger 26.

The development cartridge attachment portion 107 is configured such that the development cartridge 1 is attached thereto and detached therefrom. The development cartridge attachment portion 107 includes a drum bottom wall 108.

The drum bottom wall 108 is a lower end part of the development cartridge attachment portion 107. The drum bottom wall 108 is formed substantially in a plate shape extending in the front-to-rear direction and the left-to-right direction. The drum bottom wall 108 has an engagement hole 109.

The engagement hole 109 penetrates a left rear portion of the drum bottom wall 108, and is formed substantially in a rectangular shape having a longitudinal direction along the front-to-rear direction in a plane view. A dimension of the engagement hole 109 in the front-to-rear direction is slightly longer than a dimension of the engagement projection 64 of the development cartridge 1 in the front-to-rear direction. A dimension of the engagement hole 109 in the left-to-right direction is slightly longer than a dimension of the engagement projection 64 in the left-to-right direction.

Figure 9:
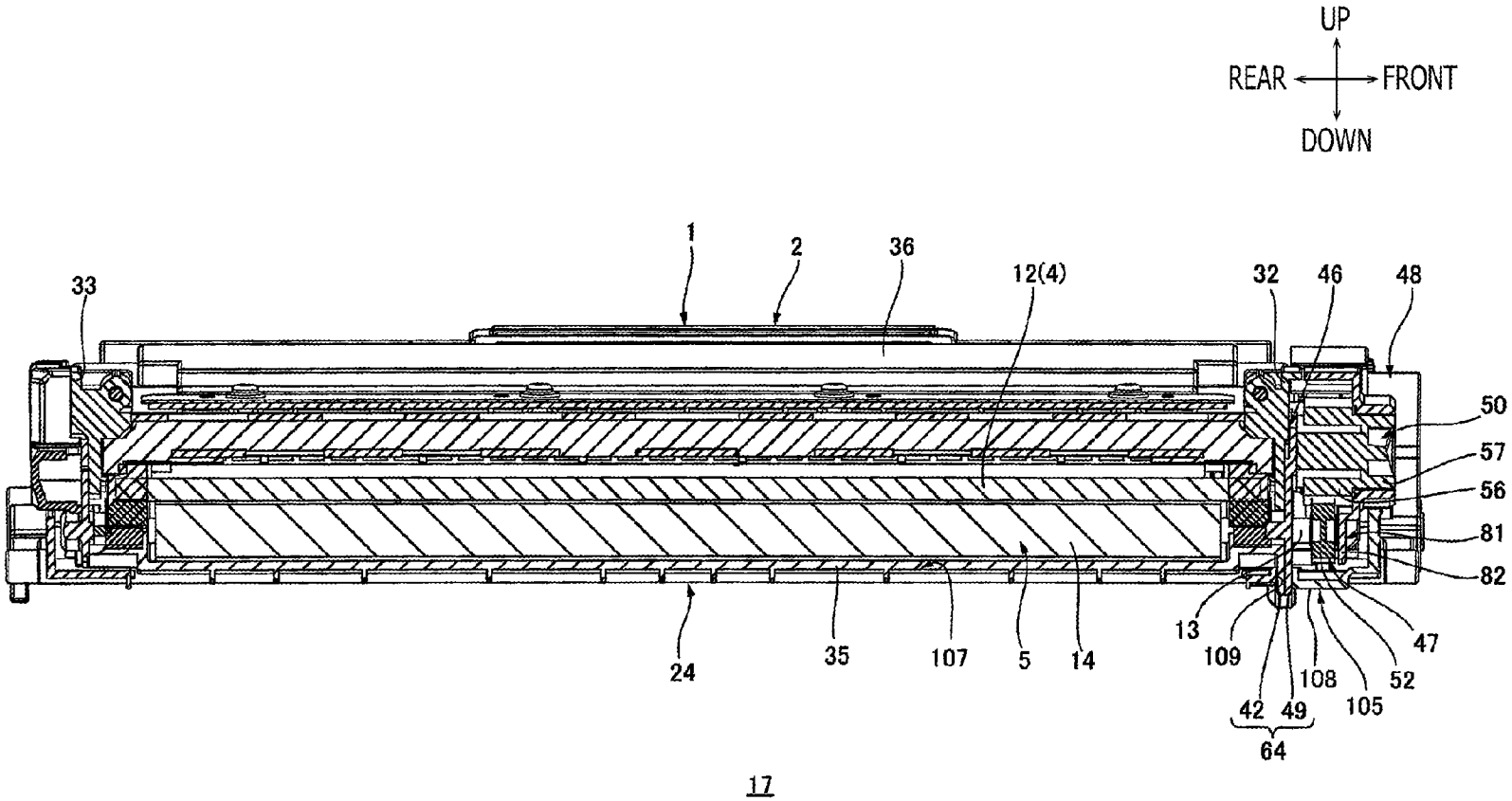
FIG. 9 is a cross-sectional side view of the process cartridge along line A-A shown in FIG. 8, in the illustrative embodiment according to one or more aspects of the present disclosure.

When the development cartridge 1 is attached to the development cartridge attachment portion 107 of the drum frame 105, as shown in FIG. 1, a rear end portion of the development roller 4 of the development cartridge 1 is brought into contact with a front end portion of the photoconductive drum 25. Further, as shown in FIG. 9, the lower wall 35 of the development frame 2 of the development cartridge 1 is positioned to face the drum bottom wall 108 of the drum frame 105. At this time, the engagement projection 64 is inserted through the engagement hole 109 of the drum bottom wall 108 from above. Further, a left rear end portion of the drum bottom wall 108 is disposed below the supply gear 52. Thereby, the left rear end portion of the drum bottom wall 108 covers the supply gear 52 so as to face upward and be opposed to the supply gear 52.

Thus, the process cartridge 17 is configured as described above.

6. Operations and Advantageous Effects

According to the development cartridge 1, as shown in FIGS. 4 and 6, both the development gear 51 and the supply gear 52 are covered with the development roller cover portion 73, the supply roller cover portion 81, and the second peripheral wall 80. Further, the supply gear 52 protrudes from the cutout portion 84 of the second peripheral wall 80 so as to expose a lower end portion of the supply gear 52.

Therefore, since the second peripheral wall 80 has the cutout portion 84 configured such that the supply gear 52 protrudes therefrom, it is possible to attain miniaturization of the gear cover 48 in the vertical direction.

Consequently, it is possible to realize miniaturization of the development cartridge 1 while protecting both the development gear 51 and the supply gear 52 with the gear cover 48.

In addition, according to the development cartridge 1, as shown in FIG. 4, the lower end portion of the supply gear 52 protrudes from the second peripheral wall 80, whereas the left surface of the supply gear 52 is entirely covered with the supply roller cover portion 81.

Therefore, it is possible to certainly protect all the left surface of the supply gear 52 while attaining miniaturization of the development cartridge 1.

Further, according to the development cartridge 1, as shown in FIG. 6, it is possible to apply grease to the supply gear 52 through the cutout portion 84 of the second peripheral wall 80.

Further, the development gear 51 and the supply gear 52 are disposed in their respective different positions in the left-to-right direction. Therefore, it is possible to apply grease to the development gear 51 through the cutout portion 84 of the second peripheral wall 80.

Hence, it is possible to efficiently apply grease to both the development gear 51 and the supply gear 52 through the cutout portion 84 of the second peripheral wall 80.

Further, according to the development cartridge 1, as shown in FIG. 3B, the supply roller shaft 13 is disposed closer to the development roller 4 than the third virtual line V3 in the front-to-rear direction (i.e., when viewed along the left-to-right direction). Therefore, the development gear 51 connected with the development roller 4 is allowed to be disposed in a position relatively close to the supply gear 52 connected with the supply roller 5.

Hence, in the development cartridge 1, it is possible to dispose the development roller 4 and the supply roller 5 in respective proper positions thereof, and to realize miniaturization of the development cartridge 1.

Further, according to the development cartridge 1, as shown in FIGS. 3B and 4, it is possible to protect a right surface of the supply gear 52 with the engagement projection 64.

Therefore, even though the lower end portion of the supply gear 52 protrudes from the cutout portion 84 of the second peripheral wall 80, it is possible to surely protect the supply gear 52.

According to the drum cartridge 24, as shown in FIGS. 7 and 9, when the development cartridge 1 is attached to the development cartridge attachment portion 107, it is possible to protect the lower end portion of the supply gear 52 that protrudes from the cutout portion 84 and is exposed, with the drum bottom wall 108. Further, it is possible to easily position the development cartridge 1 relative to the drum cartridge 24, by engaging the engagement projection 64 with the engagement hole 109.

As the engagement projection 64 protrudes from the development cartridge 1, the development cartridge 1 might be enlarged in size in a direction in which the supply gear 52 protrudes (i.e., in a downward direction). Nevertheless, according to the illustrative embodiment, when the development cartridge 1 is attached to the drum cartridge 24, the engagement projection 64 is inserted through the engagement hole 109. Thus, it is possible to prevent enlargement of the process cartridge 17.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

7. Modifications

In the aforementioned illustrative embodiment, the first virtual line V1 and the second virtual line V2 intersect each other in the first quadrant T1. Nevertheless, the development roller 4, the supply roller 5, and the layer thickness regulating blade 6 may be disposed such that the first virtual line V1 and the second virtual line V2 intersect each other in the third quadrant T3.

In the aforementioned illustrative embodiment, the gear cover 48 is provided integrally with the rear cover 66 and the front cover 67. Nevertheless, the rear cover 66 and the front cover 67 may be separatable from each other.

In the aforementioned illustrative embodiment, in the gear cover 48, the second portion 69 of the rear cover 66 is provided integrally with the second base plate 79 and the second peripheral wall 80. Nevertheless, the second base plate 79 and the second peripheral wall 80 may be separatable from each other.

Further, for instance, instead of the aforementioned development roller 4, a developer carrying body such as a brush roller and a magnetic roller may be employed.

Further, for instance, instead of the aforementioned supply roller 5, a brush-like supply member may be employed.

In the aforementioned illustrative embodiment, the process cartridge 17 is configured such that the drum cartridge 24 and the development cartridge 1 are separatable from each other. Nevertheless, the process cartridge 17 may be provided integrally with the drum cartridge 24 and the development cartridge 1.

Furthermore, the development cartridge 1 may be configured such that a toner cartridge for storing toner is detachably attached to a frame supporting the development roller 4.

What is claimed is:

1. A development cartridge comprising:

a housing configured to store developer therein;

a developer carrying body configured to rotate around a first axis extending in a first direction;

a supply member configured to rotate around a second axis along the first axis, and to contact the developer carrying body and supply the developer to the developer carrying body;

a first gear connected with an end portion of the developer carrying body;

a second gear connected with an end portion of the supply member;

a third gear configured to engage with the first gear and the second gear, wherein an engagement portion between the third gear and the first gear is in a different position in the first direction from an engagement portion between the third gear and the second gear; and a gear cover configured to cover the first gear and the second gear, the gear cover comprising:

a first cover portion extending in a second direction perpendicular to the first direction; and a second cover portion connected with the first cover portion, the second cover portion extending in the first direction, the second cover portion having an opening through which a part of the second gear is exposed.

2. The development cartridge according to claim 1, wherein the first cover portion is configured to entirely cover an end face of the second gear in the first direction.

3. The development cartridge according to claim 1, wherein a distance in the first direction between the first gear and the housing is smaller than a distance in the first direction between the second gear and the housing.

4. The development cartridge according to claim 1, wherein the part of the second gear protrudes from the second cover portion, wherein the third gear is configured to rotate around a third axis along the first axis and the second axis, wherein the supply member comprises a rotational shaft, and wherein the rotational shaft of the supply member is disposed closer to the developer carrying body than a virtual line in a view in the first direction, the virtual line being defined as a line extending along a third direction in which the part of the second gear protrudes from the second cover portion and passing through the third axis in the view in the first direction.

5. The development cartridge according to claim 1, wherein the part of the second gear protrudes from the second cover portion, and wherein the housing comprises a projection protruding in a direction in which the part of the second gear protrudes from the second cover portion, in a view in the first direction, the projection being disposed adjacent to the second gear in the first direction.

6. The development cartridge according to claim 1, wherein the housing comprises:

a development chamber; and a developer storing chamber disposed adjacent to the development chamber in the second direction, the developer storing chamber being configured to store the developer to be supplied to the development chamber, wherein the developer carrying body is disposed in the development chamber, wherein the supply member is disposed in the development chamber, and positioned on one side relative to the first axis of the developer carrying body in the second direction and on one side relative to the first axis of the developer carrying body in a third direction, the third direction being perpendicular to the first direction and the second direction, wherein the development cartridge further comprises:

an agitator disposed in the developer storing chamber, the agitator being configured to agitate the developer in the developer storing chamber; and a blade member disposed in the development chamber, the blade member extending in the third direction, the blade member being configured to regulate thickness of a layer of the developer carried on the developer carrying body, the blade member being disposed on the one side relative to the first axis of the developer carrying body in the second direction and on an other side relative to the first axis of the developer carrying body in the third direction, and wherein a first virtual line and a second virtual line intersect each other in one of a first area and a second area in a view in the first direction, where:

the first virtual line is defined as a line that passes through the first axis of the developer carrying body and a contact point between the developer carrying body and the blade member, in the view in the first direction, the second virtual line is defined as a tangential line that touches the developer carrying body and passes through a nipping point between the developer carrying body and the supply member, in the view in the first direction, the first area is defined as an area positioned on the one side relative to a first partition line in the second direction and on the other side relative to a second partition line in the third direction, in the view in the first direction, the second area is defined as an area positioned on an other side relative to the first partition line in the second direction and on the one side relative to the second partition line in the third direction, in the view in the first direction, the first partition line is defined as a line that extends along the third direction and passes through the second axis of the supply member, in the view in the first direction, and the second partition line is defined as a line that passes through the first axis of the developer carrying body and a rotational axis of the agitator, in the view in the first direction.

7. The development cartridge according to claim 6, wherein the supply member comprises a supply roller main body formed in a cylindrical shape, wherein the developer carrying body comprises a development roller main body formed in a cylindrical shape, and wherein a diameter of the supply roller main body is smaller than a diameter of the development roller main body.

8. The development cartridge according to claim 6, wherein the first virtual line and the second virtual line intersect each other in the first area.

9. The development cartridge according to claim 6, further comprising a coupling member configured to transmit an externally-transmitted driving force to the supply member and the developer carrying body, wherein the supply member comprises a rotational shaft disposed on the other side relative to a third virtual line in the second direction in the view in the first direction, the third virtual line being defined as a line that extends along the third direction and passes through a rotational axis of the coupling member, in the view in the first direction.

10. The development cartridge according to claim 7, further comprising a supporting member fixed to the housing, the supporting member being configured to support the blade member, wherein a contact portion between the supporting member and the blade member extends in the third direction.

11. The development cartridge according to claim 10, wherein the blade member is disposed between the developer carrying body and the supporting member in the view in the first direction.

12. A process cartridge comprising:

a photoconductive body cartridge; and a development cartridge detachably attached to the photoconductive body cartridge, the development cartridge comprising:

a housing configured to store developer therein;

a developer carrying body configured to rotate around a first axis extending in a first direction;

a supply member configured to rotate around a second axis along the first axis, and to contact the developer carrying body and supply the developer to the developer carrying body;

a first gear connected with an end portion of the developer carrying body;

a second gear connected with an end portion of the supply member; and a gear cover configured to cover the first gear and the second gear, the gear cover comprising:

a first cover portion extending in a second direction perpendicular to the first direction; and a second cover portion connected with the first cover portion, the second cover portion extending in the first direction, the second cover portion having an opening through which a part of the second gear protrudes from the second cover portion and is exposed, wherein the housing comprises a projection protruding in a direction in which the part of the second gear protrudes from the second cover portion, the projection being disposed adjacent to the second gear in the first direction, and wherein the photoconductive body cartridge comprises:

a photoconductive body configured to rotate around a rotational axis along the first direction; and a cartridge attachment portion configured such that the development cartridge is attached thereto, the cartridge attachment portion comprising a bottom portion disposed to face the second gear in a direction in which the part of the second gear protrudes from the second cover portion, the bottom portion having an engagement hole configured such that the projection of the housing of the development cartridge is inserted therethrough.

13. An image forming apparatus comprising:

a casing having an opening; and a process cartridge configured to be inserted into and removed from the casing through the opening, the process cartridge comprising:

a photoconductive body cartridge; and a development cartridge detachably attached to the photoconductive body cartridge, the development cartridge comprising:

a housing configured to store developer therein;

a developer carrying body configured to rotate around a first axis extending in a first direction;

a supply member configured to rotate around a second axis along the first axis, and to contact the developer carrying body and supply the developer to the developer carrying body;

a first gear connected with an end portion of the developer carrying body;

a second gear connected with an end portion of the supply member; and a gear cover configured to cover the first gear and the second gear, the gear cover comprising:

a first cover portion extending in a second direction perpendicular to the first direction; and a second cover portion connected with the first cover portion, the second cover portion extending in the first direction, the second cover portion having an opening through which a part of the second gear protrudes from the second cover portion and is exposed, wherein the housing comprises a projection protruding in a direction in which the part of the second gear protrudes from the second cover portion, the projection being disposed adjacent to the second gear in the first direction, and wherein the photoconductive body cartridge comprises:

a photoconductive body configured to rotate around a rotational axis along the first direction; and a cartridge attachment portion configured such that the development cartridge is attached thereto, the cartridge attachment portion comprising a bottom portion disposed to face the second gear in a direction in which the part of the second gear protrudes from the second cover portion, the bottom portion having an engagement hole configured such that the projection of the housing of the development cartridge is inserted therethrough.

* * * * *